United States Patent [19]

Zeller

[11] Patent Number: 4,889,260

[45] Date of Patent: Dec. 26, 1989

[54] GOLF TEE DISPENSER

[76] Inventor: Henry O. Zeller, Box 13436, Rochester, N.Y. 14613

[21] Appl. No.: 229,303

[22] Filed: Aug. 8, 1988

[51] Int. Cl.[4] ..... B65D 83/02

[52] U.S. Cl. ..... 221/197; 221/267

[58] Field of Search ..... 221/67, 281, 185, 197, 221/198, 267, 307, 308, 309, 310, 276

[56] References Cited

U.S. PATENT DOCUMENTS

| | | | |
|---|---|---|---|
| 1,926,426 | 9/1933 | Blake | 221/276 |
| 2,073,328 | 3/1937 | Wasserlein | 221/310 X |
| 2,122,003 | 6/1938 | Cooper | 221/307 X |
| 3,800,981 | 4/1974 | Zeller | 221/267 X |

FOREIGN PATENT DOCUMENTS

| | | | |
|---|---|---|---|
| 2003842 | 3/1979 | United Kingdom | 221/308 |

*Primary Examiner*—F. J. Bartuska

*Attorney, Agent, or Firm*—Robert J. Bird

[57] ABSTRACT

A golf tee dispenser includes a disposable tee pack removably insertable in a support housing. The tee pack includes front and back walls forming an open-bottom vertical passage for a stack of horizontal golf tees. A horizontal internal shelf is movable between a closed position in the passage in which it supports the stack, and an open posiition for releasing a tee through the open bottom. A floppy compliant check flap mounted to one of the walls extends into the passage to engage the tees, permitting their downward movement and obstructing their movement upward or otherwise. The support housing includes front and back walls with an open top and bottom. A rocker panel with an inward extending dispensing finger is hinged on the front wall on a horizontal axis for movement into the tee pack between tees at the bottom of the stack to move the shelf from its closed position to its open position, releasing the bottom tee.

9 Claims, 4 Drawing Sheets

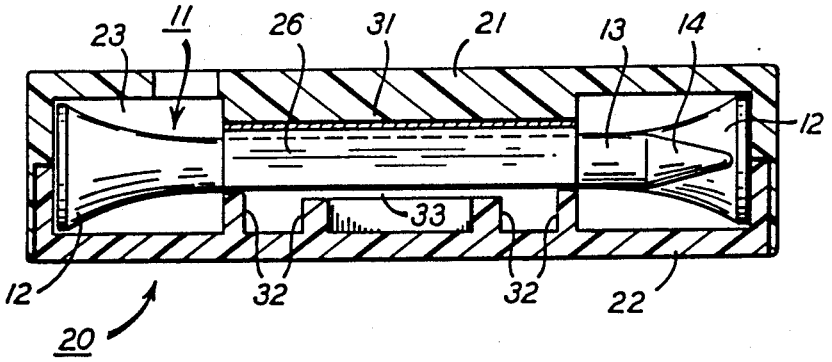
FIG. 5
FIG. 6
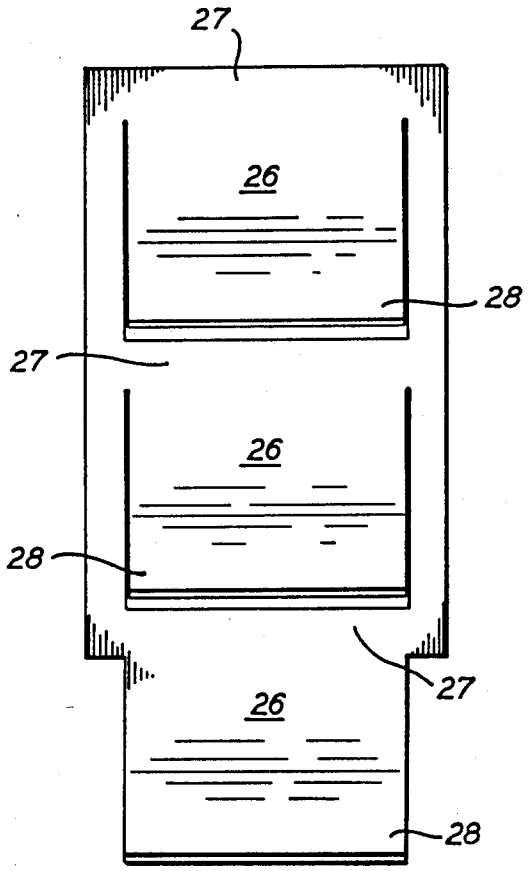

GOLF TEE DISPENSER

BACKGROUND OF THE INVENTION

1. Field of the Invention

The subject matter of this invention is a dispenser, and more specifically a portable golf tee dispenser, adapted for attachment to a golf bag or the like, for dispensing golf tees one at a time as needed by the golfer.

2. Description of the Prior Art

U.S. Pat. No. 3,800,981 was issued to me on Apr. 2, 1974. It shows and describes a Cartridge Loading Golf Tee Dispenser which is the prior art to which this invention relates. The present invention is an improvement of the tee dispenser disclosed in that patent. The specification of U.S. Pat. No. 3,800,981 is incorporated by reference herein.

The dispenser disclosed in U.S. Pat. No. 3,800,981 includes a cartridge holding a vertical stack of horizontal golf tees lying one on another, with successive tees alternating the orientation of their heads and their points. An ejector wedge moved between the bottom tee and the next adjacent tee of the stack operates to push the bottom tee through resilient retaining fingers from the cartridge, and simultaneously to prevent release of the others.

U.S. Pat. No. 3,800,981 further discloses various means to urge the tees within the cartridge toward the discharge end, and to assist gravity in discharging tees from the dispenser. A weighted follower in the tee cartridge, and a spring in the tee cartridge, are two of the suggested alternatives. These features have their limitations and disadvantages. A spring loaded cartridge, for example, is prone to ejecting a tee forcefully rather than dropping it into the user's hand. In addition, none of the disclosed expedients is effective to prevent the stack of tees from disarranging itself when the dispenser is in other than its normal vertical orientation (as when it is stored in the golf bag). The tees are subject to becoming cocked or jammed within the cartridge.

SUMMARY OF THE INVENTION

In summary, the present invention is a golf tee dispenser, including a disposable tee pack removably insertable in a support housing.

The tee pack includes front and back walls forming an open-bottom vertical passage for a stack of horizontal golf tees. A horizontal internal shelf is resiliently movable between a closed position in the passage in which it supports the stack, and an open position for releasing a tee through the open bottom. A floppy compliant check flap mounted to one of the walls extends into the passage to engage the tees, permitting their downward movement and obstructing their movement upward or otherwise.

The support housing includes front and back walls with an open top and bottom. The front wall includes a rocker panel hinged on a horizontal axis for movement into and out of the tee pack, the panel in turn including an inward extending dispensing finger. When the rocker panel is pushed, the dispensing finger moves through the front wall of the tee pack, and into engagement with the bottom tee of the stack which in turn pushes the internal shelf from its closed position to its open position, releasing the bottom tee. The dispensing finger simultaneously blocks passage of the next tee, preventing its release.

DRAWING

FIG. 5 is a sectional plan view taken along the line 5—5 of FIG. 4.

FIG. 6 is an elevation view of a series of check flaps.

DESCRIPTION OF THE PREFERRED EMBODIMENT

Figure 1:
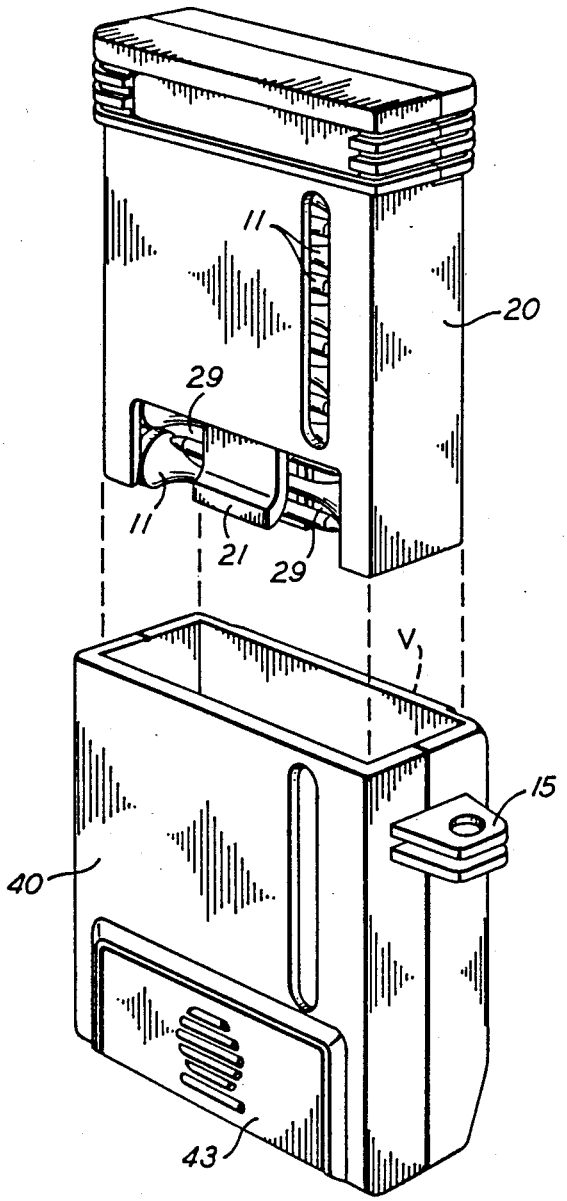
FIG. 1 is an exploded perspective view of the golf tee dispenser of this invention, including a support housing and a removable tee pack.

In the exploded view of FIG. 1, the golf tee dispenser of this invention is generally indicated at 10 and includes a removable disposable tee pack 20 about to be inserted in the open top of a support housing 40. An external holder 15 is mounted on the housing 40 for holding a tee between uses.

Figure 2:
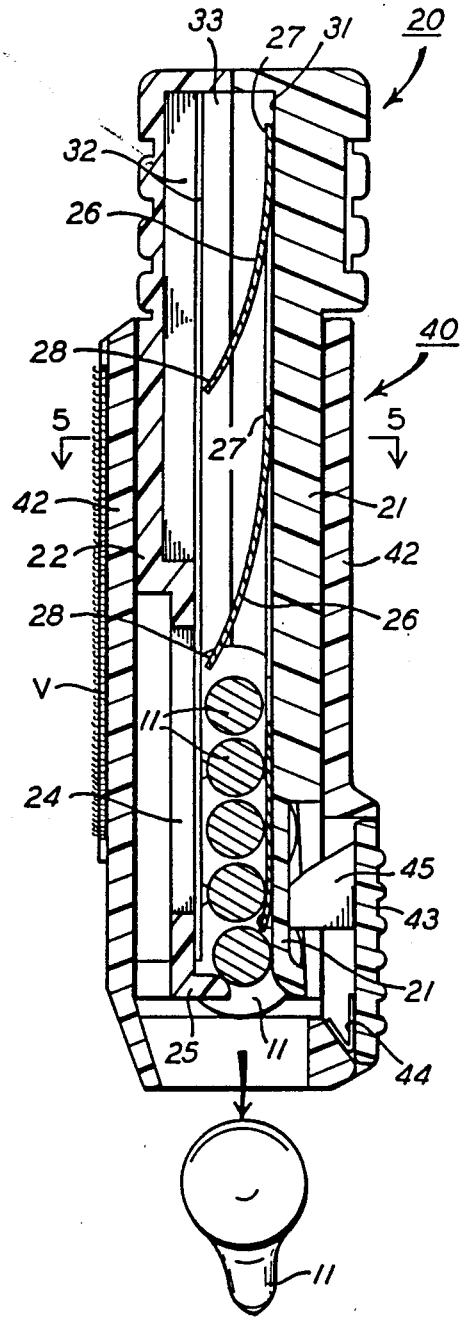
FIG. 2 is a left side sectional elevation view, showing the dispenser in a rest condition.
Figure 3:
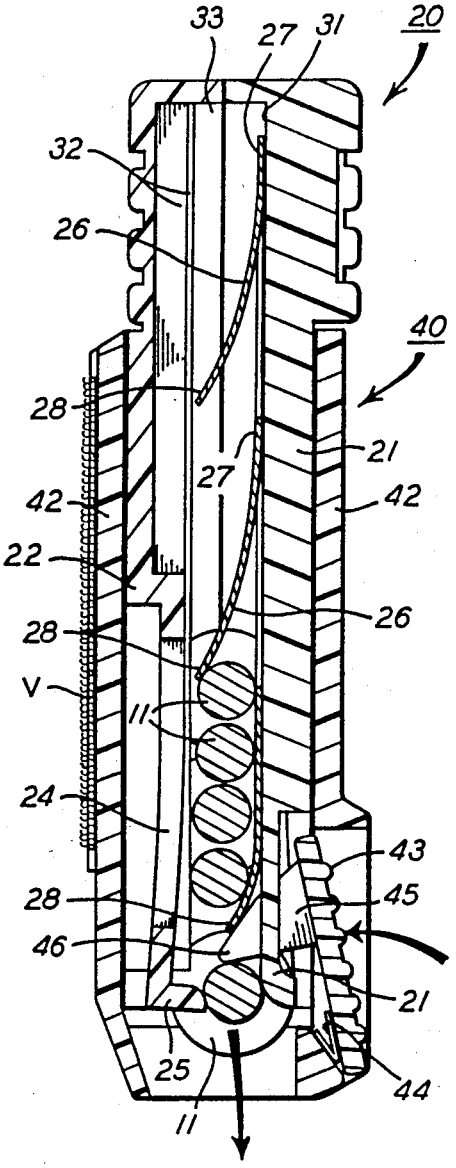
FIG. 3 is a view similar to FIG. 2, showing the dispenser in action.

Referring to FIGS. 2 and 3, the tee pack 20 includes a front member or front wall 21 and a back wall 22 forming an open-bottom vertical passage 23 for a stack of horizontal golf tees 11. Vertical spring fingers 24 extend down from the inside of the back wall 22, and they support a horizontal internal shelf 25 which extends horizontally inward from the free lower end of the spring fingers 24. In FIG. 2, the internal shelf 25 is shown in its rest or closed position in the passage 23, in which it supports a vertical stack of golf tees 11. Tees 11 lie horizontally in the stack, with alternating orientations of their heads 12 and points 14. That is, the head of one tee rests on the point of the tee below it, and so on.

Because of the flexibility of its supporting vertical spring fingers 24, the shelf 25 is movable between its closed position of FIG. 2 and an open position shown in FIG. 3 to release a tee through the open bottom. The shelf 25 is moved by an dispensing finger which is part of the supporting housing 40.

Figure 4:
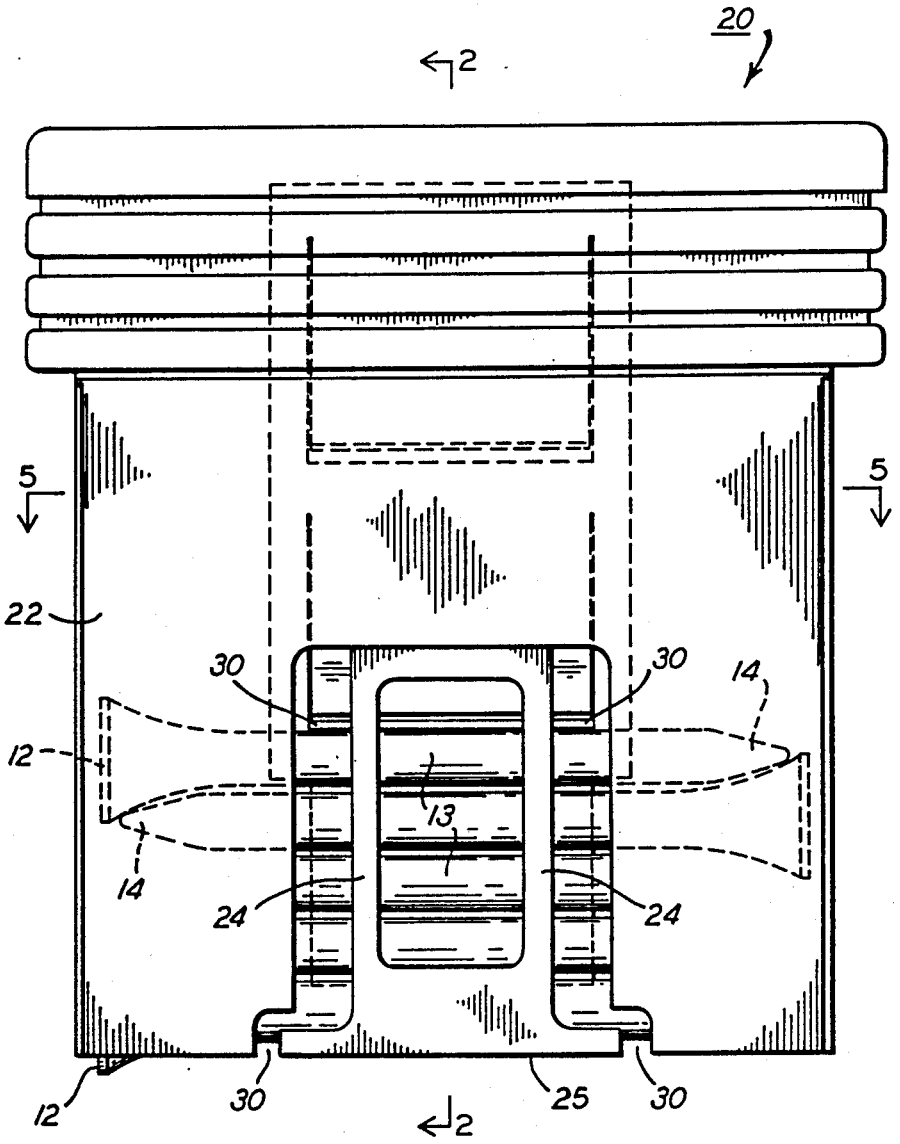
FIG. 4 is a rear view of the tee pack.

FIG. 4 is a rear view of the tee pack 20, and shows a clearance or gap 30 in the back wall 22 which permits displacelent of the vertical fingers 24 and the shelf 25.

FIG. 5 is a sectional plan view of the tee pack 20, and shows a central vertical way 31 on the inner front wall 21, and parallel vertical ribs 32 on the inner back wall 22. The central way 31 and vertical ribs 32 together form a relatively narrow slot 33 in the vertical passaage 23 in which the golf tees are stacked.

Referring back to FIGS. 2 and 3, the support housing 40 includes a front member or front wall 41 and a back wall 42 with an open top and bottom. The front wall 41 includes a rocker panel 43 on a horizontal hinge 44 for movement into and out of the tee pack. The rocker panel 43 includes a pair of parallel inward extending dispensing finger 45 having somewhat pointed or wedged leading edges 46 to facilitate their insertion between tees 11 in the stack. In FIG. 2, the rocker panel 43 is shown in its rest position. The exterior of back wall 42 of the housing 40 includes a strip V of Velcro fastening material by which to mount the dispenser on a mating strip on the surface of a golf bag.

When the rocker panel 43 is pushed in on its hinge 44, as shown in FIG. 3, the dispensing finger 45 moves through the front wall 21 of the tee pack, which is slotted at 29 (FIG. 1) to permit its entry. The two leading edges 46 of the dispensing finger move against the bottom tee of the stack, pressing the tee against the internal shelf 25 of the tee pack 20 to move the shelf 25 from its closed position (FIG. 2) to its open position (FIG. 3) to release the bottom tee. The back wall 22 of the tee pack is suitably apertured (at 30 in FIG. 4) to permit the displacement of shelf 25 away from its closed position. The dispensing finger 45, as it pushes in FIG. 3 against the bottom tee to release it, simultaneously blocks passage of the next tee, preventing its release.

Referring now to FIG. 6 in addition to FIGS. 2 and 3, a number of floppy compliant check flaps 26 are mounted to the inside of the front wall 21, in a vertical series from the upper to the lower part of the tee pack 20. Check flaps 26 each include an upper strip portion 27 mounted to the front wall 21, and a lower portion 28 hanging free of the wall. Check flaps 26 are resilient strips of sheet material with a curled configuration so as to protrude out into the vertical tee passage 23, and into partial embrace with the shanks 13 of the tees as shown. The check flaps 26 are neither stiff nor limp. They are flexible enough to permit downward movement of the tees under their own weight. They have body enough to obstruct and substantially prevent movement of the tees "upward" or otherwise. "against the grain".

The limitations of the prior art discussed in the Background section of this specification are overcome. With the check flaps 26 of this invention, the desired results are achieved. The dispenser is operable without weight-loading or spring-loading the tees; and the tees are prevented from disarranging themselves, thus preserving the arrangement of the stack regardless of the physical orientation of the dispenser.

The floppy compliant check flaps may be thought of as very soft ratchet devices, preventing rearward movement. They may also be analogized to check valves, hence the name "check flaps".

A preferred material for the check flaps 26 is Mylar. A preferred material for the support housing 40 is polypropylene, a characteristic of which is that hinge 44 is a "living hinge" with an apparent unlimited duty cycle. It is contemplated that the support housing is a permanent part of the dispenser, and that the tee pack is disposable when emptied of tees.

In this specification and in the following claims, the words "horizontal and "vertical" are used in a relative sense to indicate the relative orientations of various members. The claimed device is intended for use with its "vertical" members vertical, and its "horizontal" members horizontal, and so these terms comport with common understanding. However, since the device is pocket sized and portable, "horizontal" and "vertical" lose their meanings as absolutes, and are not intended herein in an absolute sense.

The foregoing description of this invention is intended as illustrative. The concept and scope of the invention are limited only by the following claims and equivalents thereof.

What is claimed is:

1. A golf tee dispenser, including a tee pack removably insertable in a support housing:

said tee pack including front and back walls forming an open-bottom vertical passage for a stack of horizontal golf tees: a horizontal internal shelf resiliently movable between a closed position in said passage for supporting said stack, and an open position out of said passage for releasing the lowermost of said tees through the open bottom of said tee pack; and a floppy compliant check flap depending from one of said walls to engage the shanks of said tees and extending inwardly of said passage between said lowermost tee and the next tee thereabove to permit free movement of said tees by their own weight toward said open bottom and to obstruct other movement of said tees within said tee pack;

said support housing including front and back walls and an open top and bottom; said front wall including a rocker panel mounted on an integral hinge at the lower edge of said panel for pivotal movement on an axis parallel with the axes of said tees; said panel including a dispensing finger extending inward of said housing for arcuate movement into said tee pack between the lowermost tee and the next adjacent tee of said stack to move said internal shelf from the closed position to the open position thereof and to push said lowermost tee vertically downward through the open bottom of said tee pack.

2. A golf tee dispenser as defined in claim 1 in which the width of said check flap is substantially the length of the shanks of said tees.

3. A golf tee dispenser as defined in claim 1, further including a vertical series of similar check flaps.

4. A golf tee dispenser, including a tee pack removably insertable in a support housing:

said tee pack forming a vertical passage for a stack of horizontal golf tees and including a horizontal internal shelf resiliently movable between a closed position in said passage for supporting said stack and an open position out of said passage for releasing the lowermost of said tees through the open bottom of said tee pack; and a floppy compliant check flap depending from one of said walls to engage the shanks of said tees and extending inwardly of said passage between said lowermost tee and the next tee thereabove to permit free movement of said tees by their own weight toward said open bottom and to obstruct other movement of said tees within said tee pack;

said support housing including a front rocker panel mounted on an integral hinge at the lower edge of said panel for pivotal movement on an axis parallel with the axes of said tees; said panel including a dispensing finger extending inward of said housing for arcuate movement into said tee pack between the lowermost tee and the next adjacent tee of said stack to move said internal shelf from the closed position to the open position thereof and to push said lowermost tee vertically downward through the open bottom of said tee pack.

5. A golf tee dispenser as defined in claim 4 in which the width of said check flap is substantially the length of the shanks of said tees.

6. A golf tee dispenser as defined in claim 4, further including a vertical series of similar check flaps.

7. A tee pack for removable insertion in a support housing of a golf tee dispenser, said tee pack including:

front and back walls forming an open-bottom vertical passage for a stack of horizontal golf tees;

a horizontal internal shelf resiliently movable between a closed position in said passage for supporting said stack, and an open position out of said passage for releasing the lowermost of said tees through the open bottom of said tee pack; and a floppy compliant check flap depending from one of said walls to engage the shanks of said tees and extending inwardly of said passage between said lowermost tee and the next tee thereabove to permit free movement of said tees by their own weight toward said open bottom and to obstruct other movement of said tees within said tee pack.

8. A golf tee dispenser pack as defined in claim 7 in which the width of said check flap is substantially the length of the shanks of tees.

9. A golf tee dispenser pack as defined in claim 7, further including a vertical series of similar check flaps.

* * * * *